US010144227B2

(12) United States Patent
Ramackers et al.

(10) Patent No.: US 10,144,227 B2
(45) Date of Patent: Dec. 4, 2018

(54) RECORDING SUBSTRATE TREATMENT APPARATUS, PRINTING SYSTEM AND METHOD OF DRYING

(71) Applicant: Océ-Technologies B.V., Venlo (NL)

(72) Inventors: Hendrikus G. M. Ramackers, Venlo (NL); Albert M. Van Beek, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/606,384

(22) Filed: May 26, 2017

(65) Prior Publication Data

US 2017/0266995 A1 Sep. 21, 2017

Related U.S. Application Data

(63) Continuation of application No. PCT/EP2015/077557, filed on Nov. 24, 2015.

(30) Foreign Application Priority Data

Nov. 27, 2014 (EP) ..... 14195063

(51) Int. Cl.
*B41J 11/00* (2006.01)
*B41J 13/22* (2006.01)
*B41J 29/377* (2006.01)

(52) U.S. Cl.
CPC ..... *B41J 11/0015* (2013.01); *B41J 11/002* (2013.01); *B41J 13/226* (2013.01); *B41J 29/377* (2013.01)

(58) Field of Classification Search
None
See application file for complete search history.

(56) References Cited

U.S. PATENT DOCUMENTS

2006/0001721 A1 1/2006 Yraceburu et al.
2011/0199447 A1 8/2011 Takahashi et al.

FOREIGN PATENT DOCUMENTS

JP 2010-5996 A 1/2010
JP 2010-137519 A 6/2010
(Continued)

OTHER PUBLICATIONS

Takeuchi, Hiroshi, Machine Translation of "Inkjet Printer" (JP 2011-083950 A), Apr. 28, 2011, Konica Minolta Holdings Inc., Paragraphs 0034-0045.*

(Continued)

*Primary Examiner* — Lisa M Solomon
(74) *Attorney, Agent, or Firm* — Birch, Stewart, Kolasch & Birch, LLP

(57) ABSTRACT

A recording substrate treatment apparatus includes transporting mechanism for transporting a sheet of a recording substrate through a first chamber in the interior space of the recording substrate treatment apparatus; a first suction device arranged for removing a gaseous medium from the first chamber; and an impingement device, arranged for providing a first flow of the gaseous medium at the outer surface of the transporting mechanism. The first suction device is fluidly connected to the impingement device, such that in operation the impingement device receives a first flow of the gaseous medium from the first suction device. With this arrangement, the impingement flow is balanced with an air flow directly extracted from the first chamber of the recording substrate treatment apparatus. A printing system including such a recording substrate treatment apparatus and a method of drying a recording substrate using such a recording substrate recording apparatus are also disclosed.

16 Claims, 4 Drawing Sheets

(56) References Cited

FOREIGN PATENT DOCUMENTS

| | | | |
|---|---|---|---|
| JP | 2011-83950 | A | 4/2011 |
| JP | 2011-126153 | A | 8/2011 |
| JP | 2012-51156 | A | 3/2012 |
| WO | WO 2013/131751 | A1 | 9/2013 |

OTHER PUBLICATIONS

IP.com search.*
International Search Report, issued in PCT/EP2015/077557 (PCT/ISA/210), dated Feb. 10, 2016.
Written Opinion of the International Searching Authority, issued in PCT/EP2015/077557 (PCT/ISA/237), dated Feb. 10, 2016.

* cited by examiner

RECORDING SUBSTRATE TREATMENT APPARATUS, PRINTING SYSTEM AND METHOD OF DRYING

CROSS-REFERENCE TO RELATED APPLICATIONS

This application is a continuation of PCT International Application No. PCT/EP2015/077557, filed on Nov. 24, 2015. PCT/EP2015/077557 claims priority under 35 U.S.C. § 119(a) to Application No. 14195063.4, filed in Europe on Nov. 27, 2014. The entire contents of each of the above-identified applications are hereby incorporated by reference into the present application.

BACKGROUND OF THE INVENTION

1. Field of the Invention

The present invention relates to a recording substrate treatment apparatus, in particular a recording substrate treatment apparatus for a printer or copier. For example, the recording substrate treatment apparatus comprises at least one of a drying device for drying a recording substrate and a fixing device for fixing a printing substance on a recording substrate. For example, the fixing device may be or comprise a fuser. The present invention further relates to a printer or printing system comprising a recording substrate treatment apparatus.

2. Description of Background Art

In the field of copying and printing, it is known to dry or fix prints on a recording substrate. For example, a fuser is known for fixing toner powder to a printing substrate, such as a sheet of paper. For example, a fuser comprises a radiant heat lamp, which may be arranged to heat a printing substrate support roller for heating and bonding the toner to the paper.

Fixation of a printing substance to a recording substrate usually involves heating the recording substrate comprising the printing substance and evaporating a solvent and/or water stemming from the printing substance (e.g. an ink).

In inkjet printing, in particular water based inkjet printing on flexible absorbing recording substrates (such as plain paper and machine or offset coated paper), deformation of the recording substrate may occur upon drying of the recording substrate and/or fixation of the printed image on the recording substrate. Such deformation may, at least in part, be prevented by rigidly fixing a recording substrate during drying and fixation. For example, a sheet of a recording substrate may be rigidly fixed on a transportation mechanism by a vacuum force induced by a suction device.

In the published international patent application WO 2013/131751 A1, a recording substrate treatment apparatus comprises a transporting mechanism for transporting a sheet of a recording substrate; a suction device to provide a vacuum force at an outer surface of the transporting mechanism arranged for holding down a sheet of a recording substrate; a heating device for directly heating the recording substrate; and a blowing device for providing a flow of a gaseous medium at the outer surface of the transporting mechanism, wherein in operation the blowing device receives the gaseous medium from the suction device.

The disclosed recording substrate treatment apparatus comprises an in-box (26) to which, in operation, all air-flows extracted from the drying and fixation device 20 are fed. The in-box (26) is in fluid connection with an out-box (28) from which all air-flows to different functional parts (e.g. impingement device(s), heater cooling) in the drying and fixation device (20) are fed. This arrangement has been designed to balance air-flows in the drying and fixation device (20) to prevent pressure fluctuations in the interior space of the drying and fixation device (20). The arrangement also enables venting of a fraction of the total air via an exit of the in-box (26) and taking in fresh air in the out-box (28) to compensate said fraction, such that the (relative) humidity inside the drying and fixation device (20) can be controlled.

It is a disadvantage of the recording substrate treatment apparatus disclosed in the background art that, due to the dynamics of the different air flows, the disclosed configuration is an ill balanced system.

It is another disadvantage of the recording substrate treatment apparatus disclosed in the background art that each air-flow requires a separate suction or blowing device (fan), at least for each different function, which may result in a complex and expensive configuration, requiring a complex control configuration.

It is another disadvantage of the recording substrate treatment apparatus disclosed in the background art that all incoming air-flows are mixed and redistributed, which does not enable the most energy efficient way of operation, e.g. the incoming air-flow from the air suction drum to hold down the print substrates may be (slightly) cooled due to adiabatic processes.

SUMMARY OF THE INVENTION

It is therefore an object of the present invention to provide a recording substrate treatment apparatus that comprises an air management system that is well balanced, less complex in configuration, operation and control, less expensive and more energy efficient, which is still suitable for use in a highly productive printer or printing system, which has a large drying capacity.

The object is achieved in a first aspect of the present invention by providing a recording substrate treatment apparatus comprising:

- a transporting mechanism configured to transport a sheet of a recording substrate through a first chamber in an interior space of the recording substrate treatment apparatus;
- a first suction device configured to remove a gaseous medium from said first chamber; and
- an impingement device configured to provide a first flow of the gaseous medium at the outer surface of the transporting mechanism,
- wherein the first suction device is fluidly connected to the impingement device, such that in operation the impingement device receives a first flow of the gaseous medium from the first suction device.

In this arrangement, the flow of gaseous medium required for impingement is balanced with the flow of gaseous medium extracted from the first chamber in the interior space of the recording treatment apparatus. The first suction device, the first chamber and the impingement device form a substantially closed circuit. In operation, the first flow of the gaseous medium is generated and advanced by the first suction device.

The impingement device is arranged opposite to the outer surface of the transporting mechanism for refreshing the gaseous medium at the outer surface of the transporting mechanism.

An advantage of this arrangement is that by impinging a first flow of the gaseous medium on the surface of a printed (and hence wet) recording substrate, the stationary and/or laminar boundary layer of the gaseous medium on the surface of the drying, printed recording substrate is broken. Such boundary layer contains a relatively high amount of vaporous components due to evaporation of such components from the surface of the recording substrate. In extreme cases, such a boundary layer is saturated with vaporous components. Further evaporation of said components is therefore hindered, which thus limits the drying capacity of the recording substrate treatment apparatus. By impinging a flow of the gaseous medium on the surface of the printed recording substrate, the boundary layer is broken down and refreshed with gaseous medium containing no or less vaporous components. The drying capacity of the recording substrate treatment apparatus is therefore increased.

In an embodiment, the first suction device comprises a first fan comprising a first inlet and a first outlet, wherein the first inlet is connected to at least one removal device configured to remove the gaseous medium from the first chamber in the interior space of the recording substrate treatment apparatus, and wherein the first outlet is connected to the impingement device.

In this embodiment, a single fan is used for balancing the suction of gaseous medium from the first chamber in the interior space of the recording treatment apparatus and the impingement of the gaseous medium onto a recording substrate. In operation, the first flow of the gaseous medium is generated and advanced by the first fan in the first suction device.

In an embodiment, the recording substrate treatment apparatus further comprises:

a second suction device configured to provide a vacuum force for holding down the recording substrate on the outer surface at an outer surface of the transporting mechanism; and a heating device configured to heat the recording substrate, the heating device comprising a cooling device configured to cool the heating device, wherein the second suction device is fluidly connected to the cooling device, such that in operation the cooling device receives a second flow of the gaseous medium from the second suction device.

In this embodiment, a second flow of the gaseous medium provided by the second suction device is directly used to cool the heating device and prevents the heating device from getting overheated. On the other hand, the waste heat of the heaters (i.e. the heat that is not directly used to heat the recording substrate) is used to heat the gaseous medium, which increases the saturation pressures of vaporous components in the gaseous medium and hence the drying capacity. In operation, the second flow of the gaseous medium is generated and advanced by the second suction device. The second flow of the gaseous medium provided by the second suction device may be larger than a required cooling flow. An excess of the second flow of the gaseous medium provided by the second suction device may be reintroduced in the first chamber.

The heating device may be a heating device for directly heating the recording substrate, in particular a radiation heating device, such as medium-wave and carbon (CIR) infrared heaters, which operate at filament temperatures of around 1200 C. They reach maximum power densities of up to 60 $kW/m^2$ (medium-wave) and 150 $kW/m^2$ (CIR).

Directly heating of a sheet of recording substrate in the context of the present invention should be construed as transferring thermal energy (heat) to the sheet of the recording substrate mainly by conduction (e.g. with a heated platen) and/or radiation (e.g. with a radiation heater). Convective heat transport (e.g. via a gaseous medium) may have a contribution to the heating of the recording substrate. However, such contribution is small relative to heating by conduction and/or radiation. Therefore, heating of the recording substrate mainly by circulating a hot (gaseous) medium, e.g. hot air is not considered to be a form of direct heating in the context of the present invention.

The use of a heating device for directly heating the recording substrate significantly improves the drying capacity of a recording substrate treatment apparatus. The recording substrate treatment apparatus can therefore be suitably used in a highly productive printer or printing system.

Heating by conduction (e.g. with a heated platen) may be relatively slow, in particular when compared to direct heating with radiation. Therefore direct radiation heating of a sheet of recording substrate in a highly productive printer or printing system is preferred. It is an additional advantage of direct heating by radiation that by switching off the radiation heaters, the heating of the substrate may be immediately stopped. This may be particularly advantageous in cases of calamities in the printing process, e.g. paper jams. Paper jams may cause accumulation of sheets of recording substrate, e.g. paper, in the recording substrate treatment apparatus. In highly productive printing processes, large amounts of heat are supplied to a large number of sheets of recording substrate, which increases the risk of fire in case of a calamity. Directly stopping the thermal energy supply to the print substrates prevents these sheets from overheating or catching fire.

In an embodiment, the transporting mechanism comprises a suction box for providing a vacuum force for holding down the recording substrate on the outer surface of the transporting mechanism, wherein the second suction device comprises a second fan comprising a second inlet and a second outlet, and wherein the second inlet is connected to said suction box and the second outlet is connected to the cooling device.

In operation, the flow of the gaseous medium (e.g. air) from the second suction device (e.g. suction box) to provide a vacuum force for holding down the recording substrate (the second flow) is dependent on the degree of coverage of the outer surface of the transporting mechanism (which may for example be a drum or a belt) with sheets of a recording substrate. At a high degree of coverage, said flow will be small due to a large portion of suction holes being covered by the sheets of the recording substrate.

The flow of the gaseous medium from the second suction device is (at least partially) fed to the cooling device and said flow is used for cooling the heating device. An excess flow of the gaseous medium from the second suction device (e.g. due to a low degree of coverage of the outer surface of the transporting mechanism), which is not used for cooling the heating device, may be reintroduced in the first chamber. A duct between the first chamber and the second chamber may be introduced for this purpose. In normal operation, wherein the outer surface of the transporting mechanism is maximally covered with sheets of recording substrate, the flow of the gaseous medium from the second suction device is well balanced with the flow required for cooling the heating device. In this case, the excess flow as described above will be small or even negligible.

In an embodiment, the recording substrate treatment apparatus further comprises a second chamber and a third fan comprising a third inlet and a third outlet, wherein the second outlet and the third inlet are fluidly connected to the second chamber, and wherein the third out let is fluidly connected to the cooling device arranged for cooling the heaters.

In a further embodiment, the recording substrate treatment apparatus further comprises a duct arranged for fluidly connecting the first chamber and the second chamber.

In this embodiment, the second suction device, the first chamber, the second chamber, the third fan and the cooling device of the heating device form a substantially closed circuit. The required capacity for cooling the heating device is independent of the flow of the gaseous medium from the suction box to provide a vacuum force for holding down the recording substrate, which is dependent on the degree of coverage of the transporting mechanism with sheets of a recording substrate. Cooling of the heaters can be independently controlled (by the third fan). A mismatch between the flow coming from the suction box and the flow required for cooling the heaters can be compensated for by reintroduction of an excess flow coming from the suction box into the first chamber and/or by additional supply of gaseous medium to the second chamber, e.g. sucking or leaking in fresh air into the second chamber or by arranging additional suction devices in the first chamber of the recording substrate treatment apparatus, which additional suction devices are then in fluid connection with the second chamber. The latter is also dependent on the amount of discharged gaseous medium, as described below. In normal operation, the transporting mechanism will be fully covered with sheets of a recording substrate. In this case, the flow of gaseous medium from the second suction device is well balanced with the flow required for cooling the heating device. In this case, the excess flow as described above will be small or even negligible.

In an embodiment, the recording substrate treatment apparatus comprises a discharge mechanism configured to discharge a portion of the gaseous medium, the discharge mechanism being arranged for controlling the (relative) humidity in the recording substrate treatment apparatus.

In the recording substrate treatment apparatus according to the present invention, which is a more or less closed system, the amount of vaporous components originating from the printing substance (e.g. ink) in the gaseous medium may increase. The closer said amount is to the saturation amount of said components in the gaseous medium, the more difficult further evaporation of said components becomes. Therefore, the drying capacity of the recording substrate treatment apparatus decreases. Usually, the vaporous components are removed from the circulating gaseous medium by, e.g. condensation. This requires cooling the gaseous medium, which is not energy efficient, or complex installations are required to recover the energy and transfer it back to the substrate treatment apparatus.

The present inventors have found that by discharging a small amount of the gaseous medium out of the substrate treatment apparatus, the amount of vaporous components can be kept well below the saturation amounts in the gaseous medium. In particular, at relatively high temperatures of the recirculating gaseous medium (e.g. 60° C. to 100° C.), a discharge of 10% of the circulating gaseous medium enables the saturation level of the gaseous medium with vaporous components to be kept below 40%, preferably between 10% and 20%, even at high printing speeds (e.g. 300 A4 pages per minute) and high marking substance coverage (e.g. 11 $g/m^2$ or higher).

By discharging an amount of the gaseous medium from the recording substrate treatment apparatus, the pressure inside the apparatus decreases. Gaseous medium present in the surroundings of the substrate treatment apparatus may leak into the recording substrate. Gaseous medium of ambient conditions (e.g. temperature and vaporous component content) mixes with the gaseous medium present in the recording substrate treatment apparatus.

In an embodiment, the recording substrate treatment apparatus further comprises a supply duct for supplying fresh gaseous medium to compensate for the discharged portion of the gaseous medium.

It is an advantage of this embodiment that the inflow of gaseous medium into the recording substrate treatment device can be controlled. Gaseous medium of ambient conditions may be pretreated (e.g. condensed and/or heated) before being mixed with the gaseous medium present in the recording substrate treatment apparatus.

In an embodiment, the recording substrate treatment apparatus comprises a sensor configured to measure the amount of a vaporous component present in the gaseous medium present in the first chamber and/or the second chamber and to control a discharge portion of the gaseous medium.

In an embodiment, the sensor is a humidity sensor, in particular a relative humidity sensor.

The substrate treatment apparatus may be provided with a controller that controls the discharge portion of the gaseous medium (e.g. humid air) based on the amount of the vaporous component (e.g. water) present in the gaseous medium measured by said sensor (e.g. a (relative) humidity sensor). The amount of vaporous components is then controlled within a predetermined range, e.g. between 5% and 50%, preferably between 10% and 20% saturation, by controlling the discharge portion of the gaseous medium as described above.

In an embodiment, the recording substrate treatment apparatus comprises a purifier configured to purify the gaseous medium, wherein the purifier is preferably arranged to receive the discharge portion of the gaseous medium.

The purifier is configured to remove impurities present in the gaseous medium before discharging the gaseous medium (e.g. to the environment) or reusing it in the recording substrate treatment apparatus or anywhere else in the printing system.

In an embodiment, the recording substrate treatment apparatus comprises an energy transfer system configured to recover energy from the gaseous medium, wherein the energy transfer system is preferably arranged to receive the discharge portion of the gaseous medium.

The energy transfer system may be arranged to recover the (latent) energy present in the discharge portion of the gaseous medium and reuse such energy in the substrate treatment apparatus or anywhere else in the printing system.

In an embodiment, the energy transfer system comprises a condenser configured to remove a vaporous component, in particular water vapor, from the gaseous medium.

The gaseous medium is cooled (i.e. the energy is transferred and preferably reused in the recording substrate treatment apparatus anywhere else in the printing system) and the vaporous components condensate and are separated from the gaseous medium. The gaseous medium leaving the condenser (preferably the discharge portion of the gaseous medium) is therefore cool and virtually free of vaporous components. Condensation on any parts of the printing system is thus prevented or at least mitigated.

In an embodiment, the condenser comprises a heat exchanger adapted for condensing liquid from a gaseous medium at a first side of the heat exchanger and for providing energy from latent heat, which is released by said condensing of liquid, at a second side of the heat exchanger, the second side being separate from said first side. Thus, the condenser may provide cooled gaseous medium and may provide said energy from latent heat separate from said cooled air. Nevertheless, in an embodiment, said provided energy may be used to heat said cooled gaseous medium provided from the condenser. For example, dried, reheated gaseous medium may be recycled to the surroundings of a printing substrate.

For example, the energy transfer system may comprise a heat pump. For example, the heat pump may be adapted to provide, at a heating device side of the heat pump, a higher temperature than a temperature at a condenser side of the heat pump. In an embodiment, the energy transfer system employs a heat transfer fluid. Such an energy transfer fluid may be any fluid well known in the art for use as a heat transport fluid (e.g. the fluid known as R134a). It is however envisaged that advantageously carbon dioxide (as a heat transfer fluid also referred to as R744) may be employed in view of the temperature that may be reached in an embodiment of a drying device arranged in a printing apparatus.

Further, it is envisaged that energy may be retrieved not only from condensing evaporated liquid stemming from the printing substance, but also from the printing substrate that was heated to evaporate said liquid. So, in an embodiment, a printing apparatus is provided with a mechanism such as a suitable heat pump to receive heat from a substrate at the moment that such substrate has been heated, e.g. for drying.

In another or further embodiment, energy may be retrieved from other parts of the printing apparatus. For example, heated gaseous medium may be cooled and retrieved heat energy may be transferred to the heating device of the present invention. Similarly, employing a suitable heat transfer system such as a heat pump, heat energy may be retrieved from an environment of the printing apparatus and supplied to the heating device. The environment may be heated by the printing apparatus and may thus be cooled again, while at least partly reusing the earlier consumed energy.

In the embodiments as described above, the gaseous medium is preferably air.

Water based inks are particularly preferred as a marking substance because of their HS&E friendliness. In such cases, the main vaporous component in the embodiments as described above comprises water vapor.

It is noted that the invention is not limited to the above described embodiments, in particular embodiments comprising multiple first suction devices and/or multiple impingement devices, and/or multiple second suction devices and/or multiple heating devices (multiple) cooling devices are also within the scope of the present invention, as long as the fluid connections between said devices are arranged as described above, e.g. by using manifolds to fluidly connect the multiple first suction devices with the multiple impingement devices (and using a single fan).

In a second aspect, the present invention pertains to a printing system comprising the recording substrate treatment apparatus according to the first aspect of the present invention; and an inkjet printing module comprising an inkjet printing device, wherein the inkjet printing device is adapted to jet droplets of an inkjet marking material, in particular an aqueous inkjet ink, to form an image on an image recording substrate.

In an embodiment, the printing system comprises the recording substrate treatment apparatus according to the first aspect of the present invention, wherein the (relative) humidity in the inkjet printing module is controlled with the aid of a humidifier and wherein the humidifier receives the discharge portion of the gaseous medium from the recording substrate treatment apparatus.

In this embodiment, the humid air generated in and discharged from the recording substrate treatment apparatus may contain a larger amount of moist air than the ambient air. Hence, in order to obtain the desired (relative) humidity in the printing module (to prevent drying of the ink in the printing device) it is more energy efficient to use the (purified) discharged air from the substrate treatment apparatus as a feed flow to the humidifier, because less water has to be evaporated to reach the desired humidity than when ambient air is used.

In a third aspect, the present invention pertains to a method of drying a recording substrate by using the recording substrate treatment device according to the first aspect of the present invention, the recording substrate treatment device comprising:

a transporting mechanism configured to transport a sheet of a recording substrate through a first chamber in the interior space of the recording substrate treatment apparatus;

a first suction device configured to remove a gaseous medium from said first chamber;

an impingement device configured to provide a first flow of the gaseous medium at the outer surface of the transporting mechanism, wherein the first suction device is fluidly connected to the impingement device, such that in operation the impingement device receives the gaseous medium from the first suction device;

the method comprising the steps of:

transporting a sheet of a recording substrate comprising an image of a marking substance on an outer surface of the transporting mechanism through the first chamber;

extracting a portion of a gaseous medium forming the first flow from the first chamber; and feeding the first flow of the gaseous medium to the impingement device.

The first suction device and the impingement device form a substantially closed circuit.

In an embodiment, the recording substrate treatment device further comprises:

a second suction device configured to provide a vacuum force for holding down the recording substrate on the outer surface of the transporting mechanism; and a heating device configured to heat the recording substrate, the heating device comprising a cooling device configured to cool the heating device, wherein the second suction device is fluidly connected to the cooling device, such that in operation the cooling device receives a second flow of the gaseous medium from the second suction device, the method further comprising the steps of:

fixing a sheet of a recording substrate comprising an image of a marking substance on an outer surface of a transporting mechanism by a vacuum force generated by a first suction device, the image facing upward relative to the outer surface of the transporting mechanism;

transferring heat to the recording substrate by the heating device; and cooling the heating device by feeding at least a portion of the second flow of the gaseous medium received from the second suction device towards the outer surface of the transporting mechanism.

In a further embodiment, the recording substrate treatment device further comprises a duct arranged for fluidly connecting the first chamber and the second chamber, wherein the method further comprises the step of reintroducing an excess of the second flow of the gaseous medium via said duct.

In normal operation, the transporting mechanism will be fully covered with sheets of a recording substrate. In this case the flow of gaseous medium from the second suction device is well balanced with the flow required for cooling the heating device. In this case, the excess flow as described above will be small or even negligible.

In an embodiment, the method comprises an additional step of discharging a portion of the gaseous medium from the recording substrate treatment apparatus.

In an embodiment, the method comprises an additional step of controlling a discharge portion of the gaseous medium.

In the present embodiment, the amounts of vaporous components present in the gaseous medium are measured by using a sensor suitable for measuring such amounts, in particular a humidity sensor for measuring (relative) humidity of the gaseous medium. Based on the measured content of vaporous components in the gaseous medium relative to the saturation amounts of such components in the gaseous medium, a discharge portion of the gaseous medium is determined and controlled to bring the content of vaporous components in the gaseous medium within a predetermined range. When the vaporous component is water vapor, the discharge portion is adapted such that the (relative) humidity of the gaseous medium is within a predetermined range. For example the relative humidity of the gaseous medium is controlled to be within the range of between 5% and 60%, preferably between 7% and 40%, more preferably between 10% and 25%.

In an embodiment, the method comprises an additional step of supplying fresh gaseous medium to the recording substrate treatment apparatus.

In an embodiment, the method comprises an additional purification step. In the present embodiment the gaseous medium, in particular the discharge portion of the gaseous medium, is purified before discharging the gaseous medium (e.g. to the environment) or reusing it in the recording substrate treatment apparatus or anywhere else in the printing system. The purification step involves removing impurities, such as contaminants (dust, grease particles, etc.) present in the gaseous medium.

In an embodiment, the method comprises an additional step of recovering energy from the gaseous medium, in particular the discharge portion of the gaseous medium. In the present embodiment, the gaseous medium is received by an energy transfer system, which may be arranged to recover the (latent) energy present in the gaseous medium and reuse such energy in the substrate treatment apparatus or anywhere else in the printing system.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 3B is a schematic representation of a recording substrate treatment apparatus according to an embodiment of the present invention; and.

DETAILED DESCRIPTION OF THE PREFERRED EMBODIMEMTS

Figure 1:
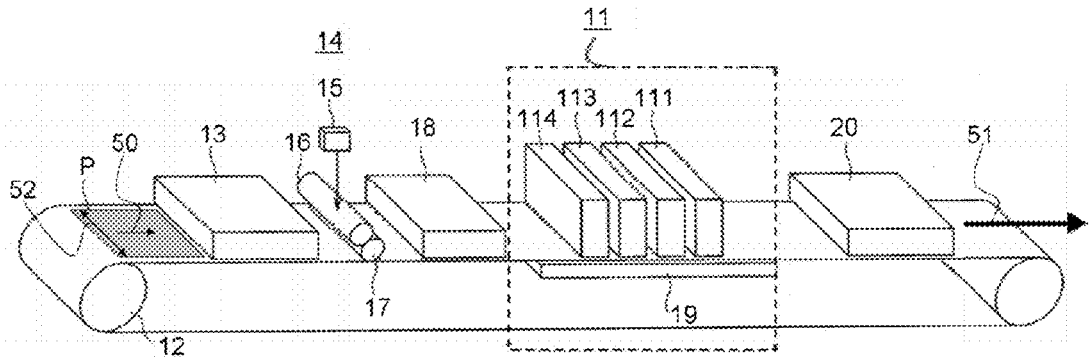
FIG. 1 is a schematic representation of an inkjet printing system.

The present invention will now be described with reference to the accompanying drawings, wherein the same or similar elements have been identified with the same reference numerals throughout the several views.

Printing Process

Figure 2:
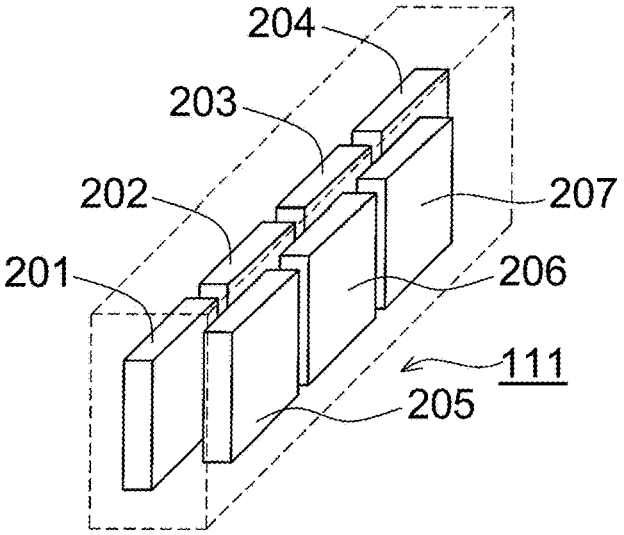
FIG. 2 is a schematic representation of an assembly of inkjet heads.

A printing process in which the inks according to the present invention may be suitably used is described with reference to the appended drawings shown in FIG. 1 and FIG. 2. FIGS. 1 and 2 are schematic representations of an inkjet printing system and an inkjet marking device, respectively.

FIG. 1 shows that a sheet of a receiving medium, in particular a machine coated medium P is transported in a direction for conveyance as indicated by arrows 50 and 51 and with the aid of transportation mechanism 12. Transportation mechanism 12 may be a driven belt system comprising one (as shown in FIG. 1) or more belts. Alternatively, one or more of these belts may be exchanged for one or more drums. A transportation mechanism may be suitably configured depending on the requirements (e.g. sheet registration accuracy) of the sheet transportation in each step of the printing process and may hence comprise one or more driven belts and/or one or more drums. For a proper conveyance of the sheets of receiving medium, the sheets need to be fixed to the transportation mechanism. The way of fixation is not particularly limited and may be selected from electrostatic fixation, mechanical fixation (e.g. clamping) and vacuum fixation. Of these, vacuum fixation is preferred.

The printing process as described below comprises the following steps: media pre-treatment, image formation, drying and fixing and optionally post treatment.

Media Pre-treatment

To improve the spreading and pinning (i.e. fixation of pigments and water-dispersed polymer particles) of the ink on the receiving medium, in particular on slow absorbing media, such as machine coated media, the receiving medium may be pre-treated, i.e. treated prior to printing an image on the medium. The pre-treatment step may comprise one or more of the following:

- preheating the receiving medium to enhance spreading of the used ink on the receiving medium and/or to enhance absorption of the used ink into the receiving medium;
- primer pre-treatment for increasing the surface tension of receiving medium in order to improve the wettability of the receiving medium by the used ink and to control the stability of the dispersed solid fraction of the ink composition (i.e. pigments and dispersed polymer particles). Primer pre-treatment may be performed in the gas phase, e.g. with gaseous acids such as hydrochloric acid, sulfuric acid, acetic acid, phosphoric acid and lactic acid, or in the liquid phase by coating the receiving medium with a pre-treatment liquid. The pre-treatment liquid may comprise water as a solvent, one or more co-solvents, additives such as surfactants and at least one compound selected from a polyvalent metal salt, an acid and a cationic resin; and/or corona or plasma treatment.

FIG. 1 shows that the sheet of receiving medium P may be conveyed to and passed through a first pre-treatment module 13, which module may comprise a preheater, for example a radiation heater, a corona/plasma treatment device, a gaseous acid treatment device or a combination of any of the above. Optionally and subsequently, a predetermined quantity of the pre-treatment liquid is applied on the surface of the receiving medium P at pre-treatment liquid applying member 14. Specifically, the pre-treatment liquid is provided from a storage tank 15 of the pre-treatment liquid to the pre-treatment liquid applying member 14 composed of double rolls 16 and 17. Each surface of the double rolls may be covered with a porous resin material such as sponge. After providing the pre-treatment liquid to auxiliary roll 16 first, the pre-treatment liquid is transferred to main roll 17, and a predetermined quantity is applied on the surface of the receiving medium P. Subsequently, the coated printing paper P on which the pre-treatment liquid was supplied may optionally be heated and dried by drying member 18, which is composed of a drying heater installed at the downstream position of the pre-treatment liquid applying member 14 in order to decrease the quantity of the water content in the pre-treatment liquid to a predetermined range.

To prevent the transportation mechanism 12 being contaminated with pre-treatment liquid, a cleaning device (not shown) may be installed and/or the transportation mechanism may be comprised of multiple belts or drums as described above. The latter measure prevents contamination of the upstream parts of the transportation mechanism, in particular of the transportation mechanism in the printing region.

Image Formation

Image formation is performed in such a manner that, employing an inkjet printer loaded with inkjet inks, ink droplets are ejected from the inkjet heads based on the digital signals onto a print medium.

Although both single pass inkjet printing and multi pass (i.e. scanning) inkjet printing may be used for image formation, single pass inkjet printing is preferably used since it is effective to perform high-speed printing. Single pass inkjet printing is an inkjet recording method with which ink droplets are deposited onto the receiving medium to form all pixels of the image by a single passage of a receiving medium underneath an inkjet marking module.

In FIG. 1, 11 represents an inkjet marking module comprising four inkjet marking devices, indicated with 111, 112, 113 and 114, each arranged to eject an ink of a different color (e.g. Cyan, Magenta, Yellow and blacK). The nozzle pitch of each head is, e.g. about 360 dpi. In the present invention, "dpi" indicates a dot number per 2.54 cm.

An inkjet marking device for use in single pass inkjet printing, 111, 112, 113, 114, has a length of at least the width of the desired printing range, indicated with double arrow 52, the printing range being perpendicular to the media transport direction, indicated with arrow 50. The inkjet marking device may comprise a single printhead having a length of at least the width of said desired printing range. The inkjet marking device may also be constructed by combining two or more inkjet heads, such that the combined lengths of the individual inkjet heads cover the entire width of the printing range. Such a constructed inkjet marking device is also termed a page wide array (PWA) of printheads. FIG. 2 shows an inkjet marking device111 (112, 113, 114 may be identical) comprising 7 individual inkjet heads (201, 202, 203, 204, 205, 206, 207), which are arranged in two parallel rows, a first row comprising four inkjet heads (201-204) and a second row comprising three inkjet heads (205-207), which are arranged in a staggered configuration with respect to the inkjet heads of the first row. The staggered arrangement provides a page wide array of nozzles.

In image formation by ejecting an ink, an inkjet head (i.e. printhead) employed may be either an on-demand type or a continuous type inkjet head. As an ink ejection system, there may be usable either the electric-mechanical conversion system (e.g., a single-cavity type, a double-cavity type, a bender type, a piston type, a shear mode type, or a shared wall type), or an electric-thermal conversion system (e.g., a thermal inkjet type, or a Bubble Jet type (registered trade name)). Among them, it is preferable to use a piezo type inkjet recording head which has nozzles of a diameter of 30 μm or less in the current image forming method.

FIG. 1 shows that after pre-treatment, the receiving medium P is conveyed to an upstream part of the inkjet marking module 11. Then, image formation is carried out by each color ink ejecting from each inkjet marking device 111, 112, 113 and 114 arranged so that the whole width of the receiving medium P is covered.

Optionally, the image formation may be carried out while the receiving medium is temperature controlled. For this purpose, a temperature control device 19 may be arranged to control the temperature of the surface of the transportation mechanism (e.g. belt or drum) underneath the inkjet marking module 11. The temperature control device 19 may be used to control the surface temperature of the receiving medium P. The temperature control device 19 may comprise heaters, such as radiation heaters, and a cooling device, for example a cold blast, in order to control the surface temperature of the receiving medium within said range. Subsequently and while printing, the receiving medium P is conveyed to the downstream part of the inkjet marking module 11.

Drying and Fixing

After an image has been formed on the receiving medium, the prints have to be dried and the image has to be fixed onto the receiving medium. Drying comprises the evaporation of solvents, in particular those solvents that have poor absorption characteristics with respect to the selected receiving medium.

FIG. 1 schematically shows a recording substrate treatment apparatus being a drying and fixing device 20, which may comprise a heater, for example a radiation heater. After an image has been formed, the print is conveyed to and passed through the drying and fixing device 20. The print is heated such that solvents present in the printed image, to a large extent water, evaporate. The speed of evaporation and hence drying may be enhanced by increasing the air refresh rate in the drying and fixing device 20. Simultaneously, film formation of the ink occurs, because the prints are heated to a temperature above the minimum film formation temperature (MFT). The residence time of the print in the drying and fixing device 20 and the temperature at which the drying and fixing device 20 operates, are optimized, such that when the print leaves the drying and fixing device 20 a dry and robust print has been obtained. As described above, the transportation mechanism 12 in the fixing and drying device 20 may be separated from the transportation mechanism of the pre-treatment and printing section of the printing apparatus and may comprise a belt or a drum.

Figure 3A:
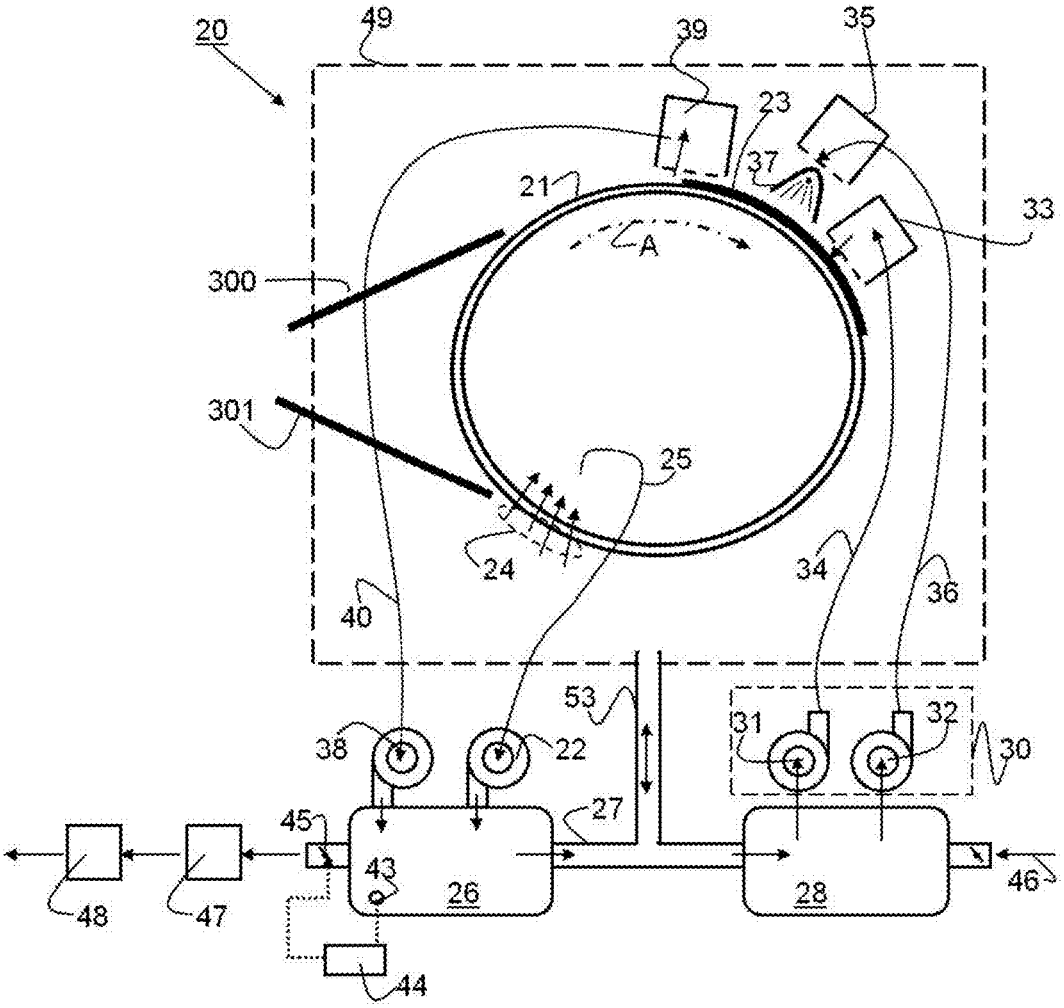
FIG. 3A BACKGROUND ART
FIG. 3A is a schematic representation of a recording substrate treatment apparatus according to an embodiment of the background art.

FIG. 3A is a schematic representation of a recording substrate treatment apparatus according to the background art cited in the published international patent application WO 2013/131751, being a drying and fixing device 20 as also schematically shown in FIG. 1.

For clarity reasons, FIG. 3A does not show all ducts connecting the parts of the drying and fixing device. The fluid connections and flows are indicated with solid arrows.

In order to create a more or less closed system, for reasons of energy efficiency, the fixing and drying device 20 may comprise a housing, indicated with an intermittent line and forming the first chamber 49.

The fixing and drying device 20 comprises a transporting mechanism 21, in the present embodiment a drum, which in operation rotates about its axial axis (not shown) in a direction indicated with arrow A. Alternatively, the transporting mechanism may be an endless belt. In either case, the outer surface of the transporting mechanism 21 is provided with a hole arranged for accommodating a suction flow for holding down a sheet of a recording substrate on the outer surface of the transporting mechanism by a vacuum force. In particular, a plurality of holes is arranged for this purpose. In operation, a sheet of a recording substrate enters the fixing and drying device 20 at position 300 and leaves it at position 301. The fixing and drying device 20 comprises a suction device 22 (corresponding to the second suction device described above), in this particular embodiment a vacuum fan arranged for providing a suction flow (corresponding to the second flow described above). The vacuum fan has an input side, which is in fluid connection with the hole or plurality of holes provided in the outer surface of the transporting mechanism 21. The hole (or plurality of holes) may extend from a first end located at the outer surface of the transporting mechanism to a second end located in a closed chamber (not shown). The closed chamber may be in fluid connection with the input side of the first suction device 22. The closed chamber may comprise the entire interior of the transporting mechanism 21, in this example a transporting drum. The closed chamber may also be arranged at an inner surface of the transporting mechanism 21. Alternatively, the closed chamber may be a suction box (not shown), which is arranged underneath a transporting belt provided with suction holes. In operation, a sheet of a recording material 23 is held down by a vacuum force and transported in the direction indicated with arrow A. At the parts of the outer surface of the transporting mechanism 21 that are not covered with a sheet of a recording substrate, air is sucked in towards the input of suction device 22, as is for example indicated with arrows 24. Thus, a suction flow is generated, as indicated with arrow 25. The suction flow rate depends on the coverage of the outer surface of the transporting mechanism 21 with sheets of recording substrate 23. The output side of the suction device 22 is in fluid connection with an in-box 26. The in-box 26 is in fluid connection with an out-box 28 via a duct 27 comprising a valve 29, e.g. a butterfly valve. The out-box is in fluid connection with a blowing device 30, in this particular example comprising two blowing fans 31 and 32. The first blowing fan 31 is in fluid connection with a first impingement device 33, as is indicated with arrow 34. The first impingement device 33 is arranged for impinging air with the outer surface of the transporting mechanism 21 and in particular with a passing sheet of a recording substrate 23. The second blowing fan 32 is in fluid connection with a second impingement device 35, as is indicated with arrow 36. The second impingement (corresponding to the cooling device described above) device 35 is arranged for impinging air onto a heating device, in this particular example a radiation heating device 37 (e.g. CIR), for cooling the heating device. The radiation heating device 37 is arranged to heat the outer surface of the transporting mechanism 21, in particular to heat a passing sheet of a recording substrate 23. The fixing and drying device 20 further comprises a suction device 38 (corresponding to the first suction device described above), comprising an inlet that is in fluid connection with an (air) removal device 39, as indicated with arrow 40. The suction device 38 comprises an outlet that is in fluid connection with the in-box 26. The air removal device 39 is arranged opposite the outer surface of the transporting mechanism 21 and in operation removes air from the surroundings of the transporting mechanism 21, in particular from the vicinity of the outer surface of the transporting mechanism 21.

FIG. 3A further shows a short cut duct 53, which is arranged to fluidly connect the first chamber 49 with duct 27. Pressure differences between the interior of the housing and duct 27, i.e. between the first chamber 49 and duct 27 (which is in fluid connection with in-box 26 and out-box 28) that may arise during operation of the fixing and drying unit 20 will level automatically. Alternatively, the short cut duct 53 may be arranged to fluidly connect the first chamber 49 directly with in-box 26 or out-box 28.

In an alternative embodiment (not shown), in the absence of duct 53, the fixing and drying device 20 may comprises a pressure sensor (not shown) operatively connected to a first flow controller (not shown). The pressure sensor may be located in the out-box 28, or near the inlet or the outlet of either the first blowing fan 31 or the second blowing fan 32. In this particular example, the first flow controller is operatively connected to the suction device 38. When, in operation, the coverage of the outer surface of the transporting mechanism 21 increases, the suction flow rate decreases. Consequently, the flow rate of the blowing device 30 decreases, which decrease in flow rate can be monitored by measuring the pressure with a pressure sensor. The air flows to the first impingement device 33, indicated with arrow 34 and to the second impingement device 35, indicated with arrow 36 will therefore decrease. The first may lead to insufficient refreshment of air at the outer surface of the transporting mechanism 21, in particular at locations where a sheet of a recording substrate is present, hence the drying capacity may decrease and even become insufficient. The second may lead to overheating of the heaters or in case of lowering the heating power to prevent overheating to insufficient drying capacity. To compensate for these effects, the air flow generated by the suction device 38 is adapted (by the first flow controller) to bring the pressure measured by the pressure sensor, within a predetermined range, in particular near the ambient pressure. The fixing and drying device 20 further comprises a humidity sensor 43, in particular a relative humidity sensor. The humidity sensor 43 is operatively connected to a second flow controller 44, which is operatively connected to a controllable valve 45, in particular a controllable butterfly valve. Alternatively, the (relative) humidity sensor may be suitably located in the inlet or outlet of suction device 22 and/or of suction device 38, or the sensor may be located in the out-box 28. In any case, depending on the (relative) humidity of the air circulating in the fixing and drying device 20, the flow controller determines a discharge portion required to maintain the (relative)

humidity of the circulating air within a predetermined range, e.g. between 10% and 20%, and controls the controllable valve 45 accordingly. Fresh make-up air may then be supplied to the out-box 28 for compensating for the discharged air, as is indicated with arrow 46.

Optionally, the discharged air may be purified by a purifier 47. The purifier may, for example be arranged to remove solid and liquid contaminants from the discharged air flow, e.g. dust, grease particles, marking substance residues, etc.

Optionally, energy may be recovered from the discharged air by an energy transfer system 48, for example a condenser. In a condenser, the discharged air is cooled below the dew point, such that condensation of the present vapors, in particular water vapor occurs. The condensation products are removed and cooled and dry air leaves the condenser. The recovered energy may be used for example to heat the make-up air.

In the present example, the interior of the housing encompasses the transporting mechanism 21, the radiation heating device 37, impingement devices 33 and 35 and the air removal device 39. The blowing device 30, the suction devices 22 and 38, the optional purifier 47 and the optional energy transfer system may also be in the interior of the housing.

The fixing and drying device 20 may suitably comprise additional devices, such as additional radiation heating devices and/or additional impingement devices and/or additional air removal devices arranged around the circumference of the transporting mechanism 21 in order to further optimize the drying and fixing efficiency of the fixing and drying device 20. The additional heating devices may be provided with additional impingement devices for cooling each individual heating device. All additional devices are in similar fluid connections as describe herein above.

Figure 3B:
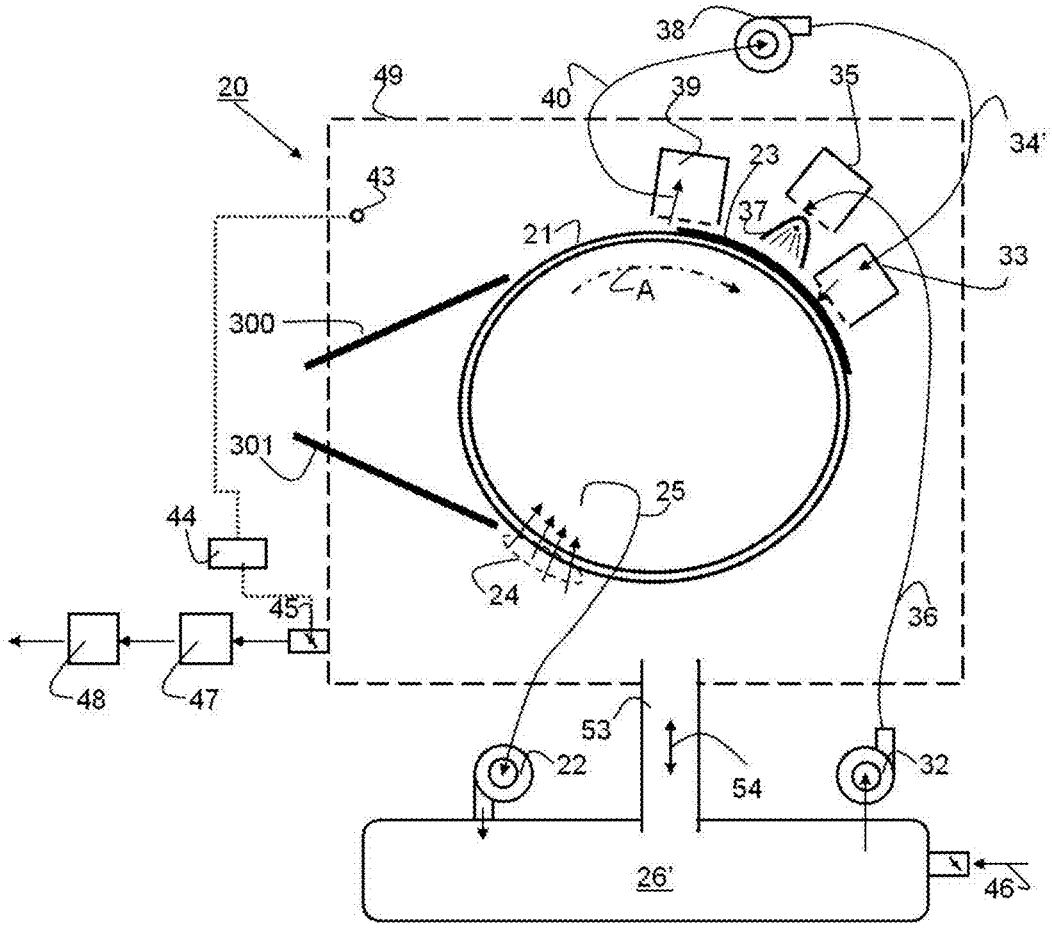

FIG. 3B shows an embodiment according to the present invention. The reference numbers correspond to the reference numbers in FIG. 3A. The devices shown in FIG. 3B have the same function as the corresponding devices shown in FIG. 3A, as is described above. However, in accordance with the present invention, the flows of gaseous medium, in particular air, in the recording substrate treatment apparatus are arranged differently compared to the recording substrate treatment apparatus from the background art.

Two substantially separate air circuits are implemented in this embodiment as is shown in FIG. 3B. The first circuit comprises (air) removal device 39, which is connected via fan 38 to impingement device 33, as indicated with arrows 40 and 34', respectively. In operation, a first flow of a gaseous medium present in the housing (corresponding to the first chamber 49 as described above) of the fixing and drying device 20 is generated by fan 38 and advanced to impingement device 33, where the first flow of the gaseous medium (re)enters the first chamber 49. The second circuit comprises a second suction device (fan) 22, for providing a suction flow (indicated with arrows 24) for holding down a sheet of a recording substrate on the outer surface of the transporting mechanism 21 by a vacuum force; the in-box 26' (corresponding to the second chamber described above), the second blowing fan 32 and the second impingement device 35 (corresponding to the cooling device described above). The circuit is further indicated with arrows 25 and 36. An excess of the flow of the gaseous medium generated by the second suction device (fan) 22, i.e. the portion of the flow of the gaseous medium generated by the second suction device that is not used for cooling the heating device, is reintroduced into the first chamber 49 via duct 53. The exchange of the gaseous medium between the first chamber and the second chamber can be both ways (as indicated by double arrow 54), the direction of exchange being dependent on the pressure difference between the first chamber and the second chamber. Optionally (not shown), the exchange of the gaseous medium between the first chamber and the second chamber can be controlled by a valve that is controlled by a controller.

In normal operation, the transporting mechanism 21 will be fully covered with sheets of a recording substrate. In this case, the flow of gaseous medium from the second suction device 22 is well balanced with the flow required for cooling the heating device generated by the second blowing fan 32. In this case, the excess flow as described above will be small or even negligible.

In operation, a second flow of a gaseous medium present in the first chamber 49 of the fixing and drying device 20 is generated by fan 22 and advanced to in-box 26'. From the in-box 26', a third flow of the gaseous medium is generated by the second blowing fan 32 and advanced to the second impingement device 35, being a cooling device for heater 37, where the third flow (re)enters the first chamber 49. In this particular embodiment, a mismatch between the second and the third flow is compensated for by exchange of gaseous medium between the first chamber and the second chamber via duct 53 as described above. The in-box 26' comprises the in-box 26 and the out-box 28 of FIG. 3A.

In this particular embodiment, the first and the second circuit only have the housing, i.e. the first chamber 49, in common. Therefore, the first circuit is substantially separate from the second circuit. In this embodiment, the humidity sensor 43, in particular a relative humidity sensor, is arranged in the first chamber 49. The humidity sensor 43 is operatively connected to flow controller 44, which is operatively connected to a controllable valve 45, in particular a controllable butterfly valve. Depending on the (relative) humidity of the air circulating in the fixing and drying device 20, the flow controller determines a discharge portion required to maintain the (relative) humidity of the circulating air within a predetermined range, e.g. between 10% and 20%, and controls the controllable valve 45 accordingly. Again, optionally, a purifier 47 and an energy transfer system 48 as described above may be used in this embodiment in a way as described above. The discharged portion may be compensated for by fresh make-up air, which may then be supplied to the in-box 26', as is indicated with arrow 46. The controller 44, which controls the discharge portion as described above, may be configured to control a flow of fresh make-up air.

Figure 4:
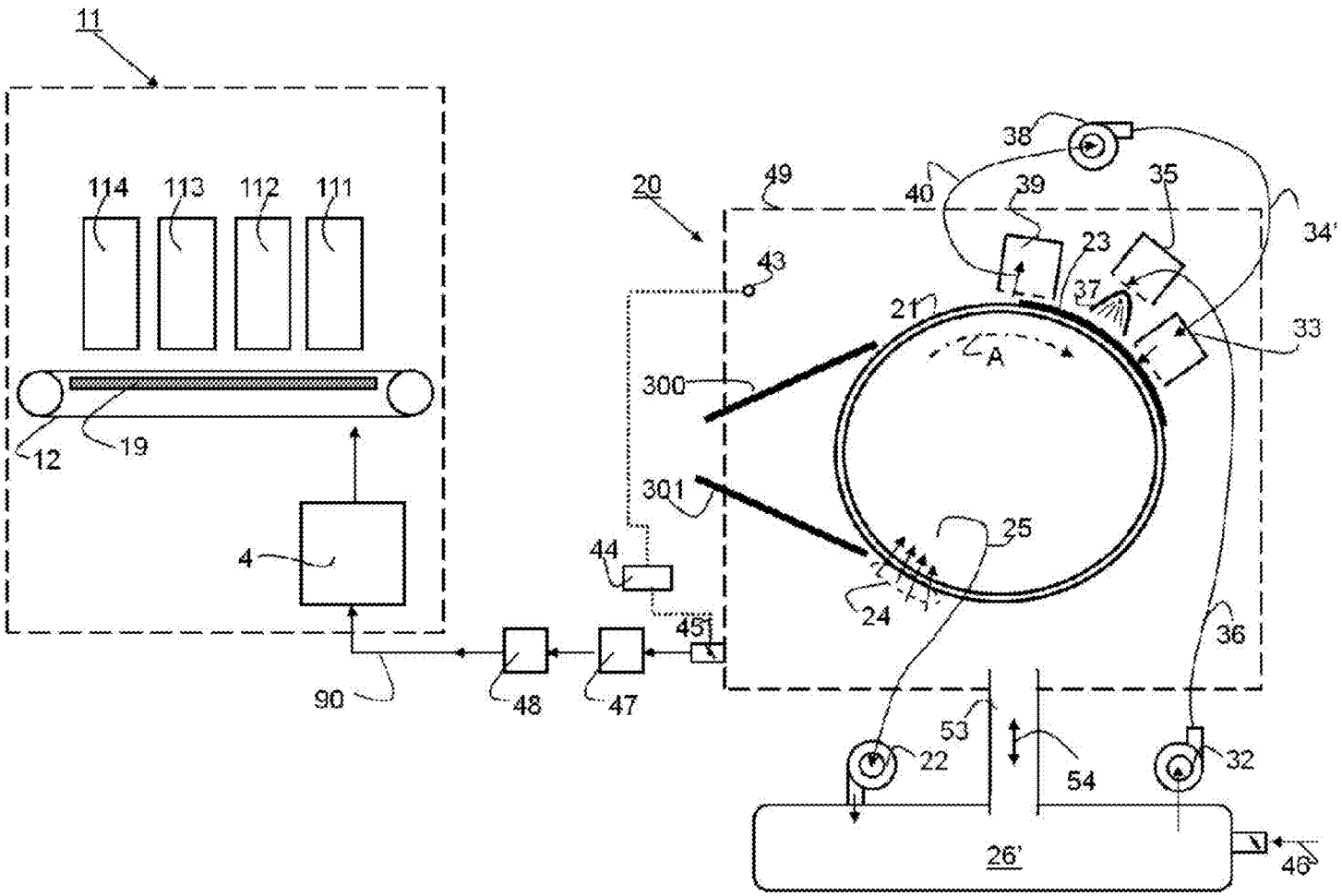
FIG. 4 is a schematic representation of a part of the inkjet printing system as shown in FIG. 1 comprising a recording substrate treatment apparatus according to an embodiment of the present invention.

FIG. 4 shows a schematic representation of a part of the inkjet printing system as shown in FIG. 1 comprising a recording substrate treatment apparatus being a fixing and drying device 20 as shown in FIG. 3B, wherein 11 represents an inkjet marking module comprising four inkjet marking devices, indicated with 111, 112, 113 and 114, as described above. The inkjet marking module comprises a humidifier 4 in order to control the (relative) humidity in the marking module, to prevent drying of the marking substance in the marking devices 111, 112, 113 and 114. To increase the efficiency of the humidifier 4, the humidifier 4 receives the purified discharge air from the fixing and drying module 20, as indicated with arrow 90. The discharge air usually has a higher (relative) humidity than the air in the surroundings of the printing device (ambient air). Therefore, the humidifier requires less energy to evaporate water to control the (relative) humidity of the air present in the inkjet marking module 11. Alternatively, the (moist) discharge air of the fixing and drying device 20 may be introduced in the bulk air (i.e. total volume of air) present in the inkjet marking module 11, or the (moist) discharge air may be suitably used anywhere else in the printing system where an elevated (relative) humidity is required. Depending on the application, the moist discharge air of the fixing and drying device 20 may be cooled or heated, prior to use in the printing system.

Hitherto, the printing process was described such that the image formation step was performed in-line with the pre-treatment step (e.g. application of an (aqueous) pre-treatment liquid) and a drying and fixing step, all performed by the same apparatus (see FIG. 1). However, the printing process is not restricted to the above-mentioned embodiment. A method in which two or more machines are connected through a belt conveyor, drum conveyor or a roller, and the step of applying a pre-treatment liquid, the (optional) step of drying a coating solution, the step of ejecting an inkjet ink to form an image and the step of drying and fixing the printed image are performed. It is, however, preferable to carry out image formation with the above defined in-line image forming method.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually and appropriately detailed structure. In particular, features presented and described in separate dependent claims may be applied in combination and any combination of such claims is herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term "in fluid connection" or "operatively connected", as used herein, are defined as connected, although not necessarily directly.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A recording substrate treatment apparatus, comprising:

a transporting mechanism configured to transport a sheet of a recording substrate through a first chamber in an interior space of the recording substrate treatment apparatus;

a first suction device configured to remove a gaseous medium from said first chamber; and an impingement device configured to provide a first flow of the gaseous medium at the outer surface of the transporting mechanism, wherein the first suction device is fluidly connected to the impingement device, such that in operation the impingement device receives a first flow of the gaseous medium from the first suction device.

2. The recording substrate treatment apparatus according to claim 1, wherein the first suction device comprises a first fan comprising a first inlet and a first outlet, wherein the first inlet is connected to at least one removal device configured to remove the gaseous medium from the first chamber in the interior space of the recording substrate treatment apparatus, and wherein the first outlet is connected to the impingement device.

3. The recording substrate treatment apparatus according to claim 1, further comprising:

a second suction device configured to provide a vacuum force for holding down the recording substrate on the outer surface of the transporting mechanism; and a heating device configured to heat the recording substrate, the heating device comprising a cooling device configured to cool the heating device, wherein the second suction device is fluidly connected to the cooling device, such that in operation the cooling device receives a second flow of the gaseous medium from the second suction device.

4. The recording substrate treatment apparatus according to claim 3, wherein the transporting mechanism comprises a suction box configured to provide a vacuum force for holding down the recording substrate on the outer surface of the transporting mechanism, wherein the second suction device comprises a second fan comprising a second inlet and a second outlet, and wherein the second inlet is connected to said suction box and the second outlet is connected to the cooling device.

5. The recording substrate treatment apparatus according to claim 4, further comprising:

a second chamber; and a third fan comprising a third inlet and a third outlet, wherein the second outlet and the third inlet are fluidly connected to the second chamber, and wherein the third outlet is fluidly connected to the cooling device.

6. The recording substrate treatment apparatus according to claim 1, further comprising a discharge mechanism configured to discharge a portion of the gaseous medium and control the humidity in the recording substrate treatment apparatus.

7. The recording substrate treatment apparatus according to claim 6, further comprising a supply duct for supplying fresh gaseous medium to compensate for the discharged portion of the gaseous medium.

8. The recording substrate treatment apparatus according to claim 1, further comprising a sensor configured to measure an amount of a vaporous component present in the gaseous medium in the first chamber and to control a discharge portion of the gaseous medium.

9. The recording substrate treatment apparatus according to claim 5, further comprising a sensor configured to measure an amount of a vaporous component present in the gaseous medium in the first chamber and to control a discharge portion of the gaseous medium.

10. The recording substrate treatment apparatus according to claim 8, wherein the sensor is a relative humidity sensor.

11. The recording substrate treatment apparatus according to claim 9, wherein the sensor is a relative humidity sensor.

12. The recording substrate treatment apparatus according to claim 1, further comprising a purifier configured to purify the gaseous medium, wherein the purifier is arranged to receive a discharge portion of the gaseous medium.

13. The recording substrate treatment apparatus according to claim 1, further comprising an energy transfer system configured to recover energy from the gaseous medium, wherein the energy transfer system is arranged to receive a discharge portion of the gaseous medium.

14. The recording substrate treatment apparatus according to claim 13, wherein the energy transfer system comprises a condenser configured to remove a vaporous component from the gaseous medium.

15. The recording substrate treatment apparatus according to claim 13, wherein the energy transfer system comprises a condenser configured to remove water vapor from the gaseous medium.

16. A printing system comprising: the recording substrate treatment apparatus according to claim 1; and an inkjet printing module comprising an inkjet printing device, wherein the inkjet printing device is adapted to jet droplets of an inkjet marking material to form an image on an image recording substrate.

* * * * *